United States Patent [19]

Rausing

[11] Patent Number: 4,878,593

[45] Date of Patent: Nov. 7, 1989

[54] PACK FOR FLOWABLE MATERIAL

[76] Inventor: Hans Rausing, Wadhurst Park, Wadhurst, East Sussex TN5 6NT, Great Britain

[21] Appl. No.: 78,221

[22] Filed: Jul. 27, 1987

[30] Foreign Application Priority Data

Jul. 28, 1986 [GB] United Kingdom ..... 8618380

[51] Int. Cl.[4] ..... B65D 25/00

[52] U.S. Cl. ..... 220/67; 220/90.4; 229/4.5

[58] Field of Search ..... 220/67, 66, 90.2, 90.4, 220/90.6, 254, 355; 229/4.5

[56] References Cited

U.S. PATENT DOCUMENTS

| | | | |
|---|---|---|---|
| 3,406,891 | 10/1968 | Buchner et al. | 220/67 X |
| 4,184,604 | 1/1980 | Amberg et al. | 220/90.4 X |
| 4,190,174 | 2/1980 | Haimowitz | 220/90.4 X |
| 4,201,306 | 5/1980 | Dubois et al. | 220/67 X |
| 4,254,891 | 3/1981 | Jeppsson | 220/355 X |
| 4,629,088 | 12/1986 | Durgin | 220/90.2 X |
| 4,667,844 | 5/1987 | Clauss | 229/4.5 X |
| 4,699,290 | 10/1987 | Adams | 220/67 X |

*Primary Examiner*—Steven M. Pollard
*Attorney, Agent, or Firm*—Paul & Paul

[57] ABSTRACT

A pack for flowable material, includes a tube (1) having at least one longitudinal seam, with a base and a lid (2) mounted at its ends. The lid (2) is made of thermoplastics material without any base material, is welded to the tube (1) and has a pouring device (8). The tube (1) is made of base material such as cardboard, coated with thermoplastics material on at least one side. The lid (2) is a separate, prefabricated part fitted by means of a flange (5) engaging round the top edge (6) of the tube (1) and welded to the edge (6). This lid (2) has a part (21) of its surface at a lower level than its outer surface, with part of the lower level surface (21) extending near to the edge (6) of the tube, in such a way that the lid (2) engages round the edge (6) of the tube substantially in a U shape in the region of said part (21) of the lower level surface.

7 Claims, 2 Drawing Sheets

PACK FOR FLOWABLE MATERIAL

Figure 1:
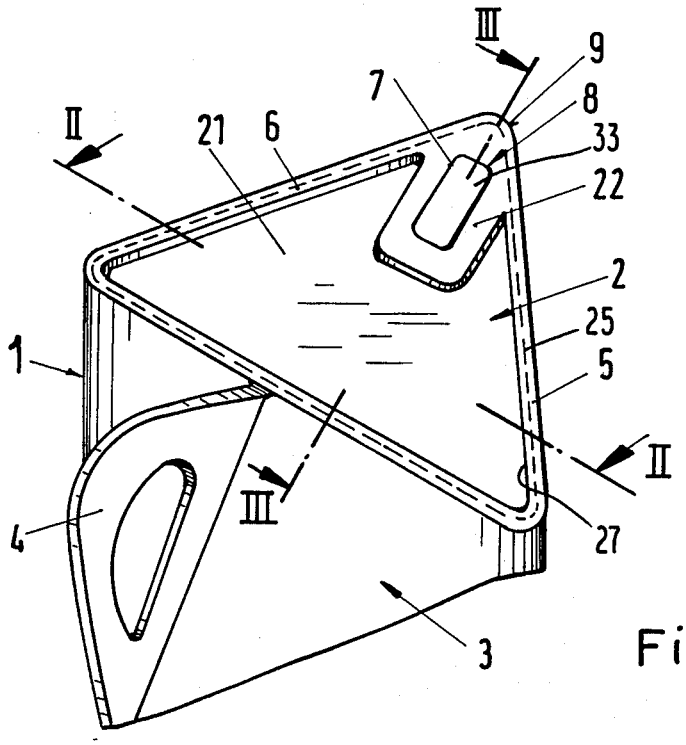

This invention relates to a pack for flowable material, including a tube having at least one longitudinal seam and a base and a lid mounted at the tube ends, which lid is made of thermoplastics material without any base material, is welded to the tube and has a pouring device, and which tube is made of base material such as cardboard, coated with thermoplastics material on at least one side.

Packs of this kind are known in many different forms. In a particular pack of this type the lid is round in plan view and is moulded onto the wall of the tube, which is round in cross-section, to ensure that the lid is fixed securely and in liquid tight manner to the top edge of the tube. This involves using expensive machines with exactly adjusted tool components, so a considerable outlay is required for packs of the known type to be produced in large quantities per unit of time.

In another known liquid pack the base is formed by a separate, flat piece of wall with thermoplastics material on at least one surface and is welded to the edge of the tube, which is round in cross-section. The plane of the base lies within the tube and is arranged transversely to the side walls of the pack, formed by the tube, the edges of the base engaging over the edge of the tube in a U shape. This form of base is chosen because it can be prefabricated cheaply and in heavy duty machines, stored and conveniently taken out of store and sealed onto the edge of the tube. Since the edge of the lid engages in a U shape over the lower edge of the tube (lower because of the base), the welding jaws can engage round the edge of the tube on both sides and exert compressible forces, whereby the most favourable sealing action and thus the most favourable liquid proofing action can be obtained.

However, if it is desired to fix the lid of the pack in this way the only possibility is to arrange the pouring device a considerable distance away from the edge of the lid. Also it would be a disadvantage to have to open such a pack and empty out its contents because the contents, on leaving the lid, would have to run to a lower level wall of the lid then flow back over the higher edge. Such a pouring action is unfavourable and undesirable. If the pouring device is required to be at the edge of the lid, then the engagement of the edge of the tube over both sides to fix the lid to the tube breaks down completely.

There is thus a need for a generally improved pack where an easily produced lid with good pouring properties can be mounted in a liquid tight manner, without the stacking properties of such a pack suffering to any marked degree.

According to the present invention there is provided a pack for flowable material, including a tube having at least one longitudinal seam and a base and a lid mounted at the tube ends, which lid is made of thermoplastics material without any base material, is welded to the tube and has a pouring device, and which tube is made of base material such as cardboard, coated with thermoplastics material on at least one side, wherein the lid is a separate, prefabricated part fitted to the tube by means of a flange engaging round a top edge of the tube and welded to the tube top edge, and wherein the lid has a part of its surface at a lower level than its outer surface, with part of the lower level surface extending near to the edge of the tube, in such a way that the lid engages round the edge of the tube substantially in a U shape in the region of said part of the lower level surface.

The prefabricated lid has a flange projecting outside the edge at one side, the diameter of the flange being such that the flange can engage round the outside of the top edge of the tube. The fact that part of the surface is lowered or drawn down towards the inside of the pack from the original external plane of the lid enables the lid material to engage over the edge of the tube in a U shape wherever the lower level part of the surface touches the edge of the tube. The lower level part of the surface is thus taken near the edge of the tube, so that it engages over the edge in a U shape as in the known base. In accordance with the invention only the region of the pouring device is recessed, so that the above-mentioned disadvantages are not met with in pouring. Furthermore, the favourable shape of the edge of the lid is utilised to apply pressure and counterpressure when welding the lid to the edge of the tube.

In accordance with the invention it is therefore particularly desirable for the lower level part of the lid surface to end some distance in front of the pouring device. If an expert were to object that the pouring device area, particularly if it is to be at the edge of the lid, does not have the favourable shape required for pressure and counterpressure in the welding process, so that sealing would not be possible in the pouring area, the invention here teaches a method whereby good welding and sealing between the lid and the tube can nevertheless be obtained at the edge of the tube. The tensile stress in the paper has to be utilised in welding the lid to the paper tube. The tensile stress can be utilised in a particularly favourable way for the opposing force of the welding jaw if the pouring aperture is in a very curved part of the edge of the lid. The lid is preferably square in plan view, and the pouring device is in a corner of the square. The angle is here approximately 90° and thus generates a not inconsiderable tensile stress in the paper. It is sufficient to support a strong opposing force when welding jaws are pressed onto the lid from the outside in the direction of the outer surface of the tube.

In accordance with the invention it also desirable for the flat surface surrounding the pouring aperture of the pouring device to be approximately at the level of the top edge of the tube. This makes it possible to optimise the pouring properties of the pouring device according to the invention, which have already been touched on above. When the outflowing liquid has left the pouring aperture, it need only flow on over the flat surface surrounding the aperture, to reach a pouring edge at the outer extremity; the stream of liquid can leave that edge and form a jet in the desired, ideal manner.

Figure 2:
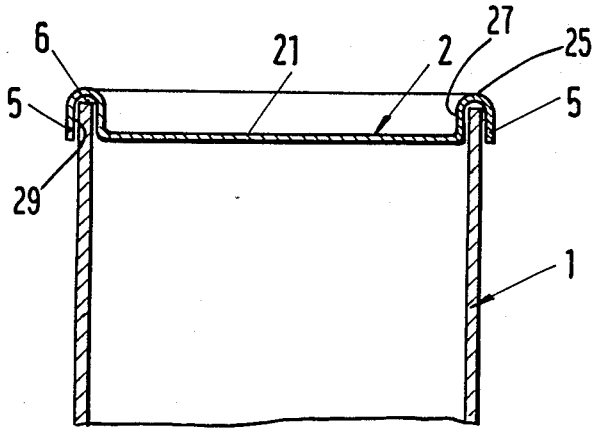
Figure 3:
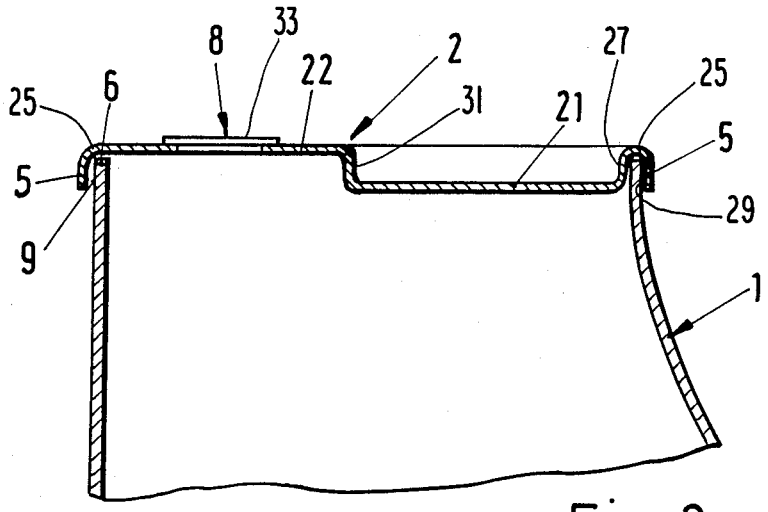
Figure 4:
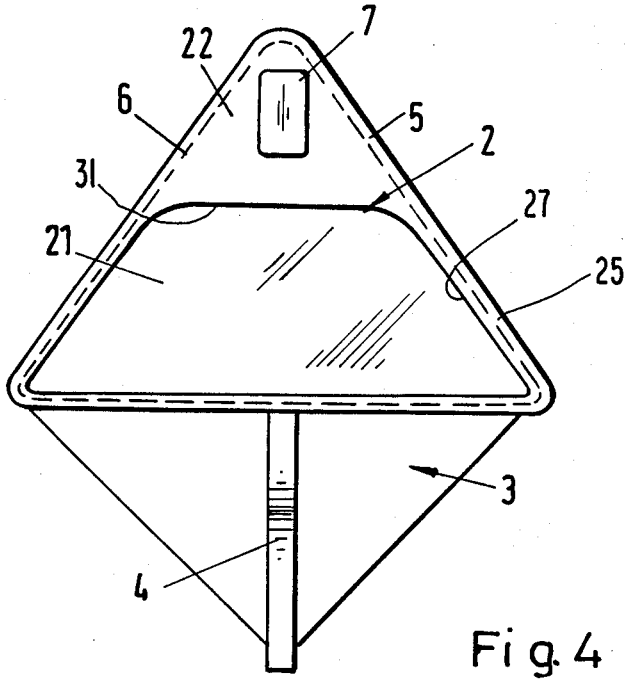

For a better understanding of the present invention, and to show how the same may be carried into effect, reference will now be made, by way of example, to the accompanying drawings, in which:

FIG. 1 is a perspective fragmentary plan view of a specially designed pack with a lid according to one embodiment of the invention, FIG. 2 is a fragmentary diagramatic cross-sectional view taken along the line II—II in FIG. 1, FIG. 3 is a cross sectional view taken along the line III—III in FIG. 1 and FIG. 4 is a plan view of a lid a pack according to a different embodiment of the invention, with part of the surface trapezoidal and at a lower level.

A pack of the invention for flowable, e.g. liquid, material has a tube 1 which forms the side surfaces and is made of paper coated with thermoplastics material on both sides. A base (not shown), which may e.g. be square, is provided at the bottom end of the tube. It is made from the folded over tube of the pack as a folded closure, and has a transverse seam with triangular flaps folded over onto an adjacent wall.

A lid 2 is triangular in plan view, with two edges running along the edges of the two flat side surfaces and the third line of the triangle, that joining these two sides, running along the diagonal, if the pack is looked at from above, with the pack being square in cross section at top and bottom. In the other half of the square, so to speak, as seen from above, there is a recess in the region 3 of the pack (FIGS. 1 and 4), such that the body of the pack tapers upwardly. A handle 4 is provided on the tapering part of the body. The lid 2 is particularly important to the invention. It is a separate, prefabricated part made of thermoplastics material without any base material. At the outer periphery it has a flange 5 which stands out at one side and engages round the top edge 6 of the tube 1.

The lid 2 also has a lower level or second interior wall part 21 of the surface, which is drawn deeper or sunk from the level 22 towards the interior of the pack. This second interior wall surrounds the pouring aperture 7 of the pouring device shown generally at 8. The upper level or wall 22 extends generally horizontally from a portion of the peripheral wall 25 and surrounds the pouring device 8. A third interior wall 31 extends generally downwardly from the upper wall 22 surrounding the pouring device 8 to the generally horizontally extending second interior wall 21. The pouring device 8 includes a generally flat upper wall 33 which lies substantially in the plane defined by the upper wall 22 of the lid and the annular peripheral wall 25.

From FIG. 2, which is a sectional view taken along the line II—II in FIG. 1, it will be seen that wherever the lower level part 21 of the surface is taken near the edge 6 of the tube the edge of the lid engages over the edge 6 in a U shape. This happens on both sides in FIG. 2, i.e. at the left and right hand side along the edge 6 of the tube, whereas in FIG. 3, which shows the section III—III in FIG. 1, it only happens at the right hand side. Because the section III—III is bent back in FIG. 1, i.e. although the centre runs through the pouring device 8 at the front it does not run through the handle 4 at the back, FIG. 3 shows not the handle but merely the oblique wall of the tube.

In the FIG. 1 embodiment the lower level part 21 of the surface is as large as possible. It surrounds the pouring device 8 as far as possible on all sides up to the front pouring tip 9, so that the engagement of the thermoplastic lid material round the edge 6 of the tube in a U shape continue even round the pouring device 8.

In the other embodiment shown in FIG. 4 the lower level part 21 of the surface has a substantially trapezoidal shape, without coming closer to the pouring aperture 7 or even enclosing it on three sides. Tests have shown that the tensile stress in the paper material of the tube 1 is such as to be well able to bear the inward pressure of the welding jaws in the vicinity of the pouring device.

I claim:

1. A pack for flowable material, the pack including:

(a) a tube made of a base material coated on at least one side with a thermoplastic material and having at least one longitudinal seam and a top end and a bottom end, the top end of the tube having an edge;

(b) a bottom fitted to the tube at the bottom end; and (c) a lid formed from a thermoplastic material and welded to the tube at the top end, the lid having a generally downwardly extending exterior flange, the lid having an annular peripheral wall, and a pouring device adjacent the peripheral wall, the flange extending downwardly from the exterior of the peripheral wall of the lid, the lid having a first interior wall extending generally downwardly from a portion of the interior of the peripheral wall, the lid having a second interior wall extending generally horizontally from the first interior wall, the downwardly extending flange, the peripheral wall, and the first interior wall forming a U-shaped groove for receiving the edge of the top end of the tube, the pouring device having an upper wall extending generally horizontally from a portion of the peripheral wall, the lid having a third interior wall extending generally downwardly from the upper wall of the pouring device to the second interior wall, the third interior wall being adapted to being grasped during welding the lid to the tube to permit the application of pressure to the portion of the flange adjacent the portion of the peripheral wall adjacent the pouring device to provide a good seal.

2. A pack according to claim 1 wherein the portion of the peripheral wall adjacent the pouring device includes a corner.

3. A pack according to claim 2 wherein the corner has an interior angle of about 90 degrees.

4. A pack according to claim 2 wherein the corner has an interior angle of about 60 degrees.

5. A pack according to claim 1 wherein the pouring device includes an aperture formed therein, the peripheral wall of the lid defining a plane, the upper wall of the pouring device lying substantially in the plane defined by the peripheral wall of the lid.

6. A pack according to claim 1 including a pouring aperture wherein the first and third interior walls meet proximate the pouring aperture, and the second interior wall partially surrounds the aperture.

7. A method for forming a pack for flowable material, the pack including:

(a) a tube made of a base material coated on at least one side with a thermoplastic material and having at least one longitudinal seam and a top end and a bottom end, the top end of the tube having an edge;

(b) a bottom; and (c) a lid formed from a thermoplastic material and having a generally downwardly extending exterior flange, the lid having an annular peripheral wall, and a pouring device adjacent the peripheral wall, the flange extending downwardly from the exterior of the peripheral wall of the lid, the lid having a first interior wall extending generally downwardly from a portion of the interior of the peripheral wall, the lid having a second interior wall extending generally horizontally from the first interior wall, the downwardly extending flange, the peripheral wall, and the first interior wall forming a U-shaped groove for receiving the edge of the top end of the tube, the pouring device having an upper wall extending generally horizontally from a portion of the peripheral wall, the lid having a third interior wall extending generally downwardly from the upper wall of the pouring device to the second interior wall, the third interior wall being adapted to being grasped during welding the lid to the tube to permit the application of pressure to the portion of the flange adjacent the portion of the peripheral wall adjacent the pouring device to provide a good seal; the method including:

(a) inserting the edge of the top end of the tube into the groove in the lid;

(b) simultaneously exerting heat and force to the portion of the lid proximate the top edge of tube and force to the third interior wall to weld the lid to the tube; and (c) fitting the bottom to the bottom end of the tube.

* * * * *

UNITED STATES PATENT OFFICE

CERTIFICATE OF CORRECTION

Patent No. 4,878,593 Dated November 7, 1989

Inventor(s) Hans Rausing

It is certified that error appears in the above-identified patent and that said Letters Patent is hereby corrected as shown below:

Column 3, Line 23, after "tube 1." insert

--The flange 5 extends generally downward by from an annular peripheral wall 25. A first interior wall 27 extends generally downwardly from a portion of the annular peripheral wall 25 generally parallel with the flange 5 such that the flange 5, the annular peripheral wall 25 and the first interior wall 27 form a U-shaped groove 29 for receiving the edge 6 of the top end of the table 1.--

Signed and Sealed this

Twenty-third Day of October, 1990

*Attest:*

HARRY F. MANBECK, JR.

*Attesting Officer*

*Commissioner of Patents and Trademarks*